United States Patent [19]

Rios

[11] Patent Number: 4,797,663

[45] Date of Patent: Jan. 10, 1989

[54] PORTABLE SECURITY MONITOR AND TIME RECORDING

[75] Inventor: Jess Rios, Tucson, Ariz.

[73] Assignee: Tekmate Industries Inc., Tucson, Ariz.

[21] Appl. No.: 25,174

[22] Filed: Mar. 12, 1987

[51] Int. Cl.[4] ..... G08B 13/08; G08B 13/18; G08B 23/00

[52] U.S. Cl. ..... 340/691; 340/541; 340/546; 340/570; 346/20; 364/550; 368/11

[58] Field of Search ..... 340/570, 691, 600, 541, 340/546, 540, 654; 346/20; 368/11; 364/550

[56] References Cited

U.S. PATENT DOCUMENTS

| | | | |
|---|---|---|---|
| 1,452,846 | 4/1923 | Pullman | 70/433 |
| 2,051,986 | 8/1936 | Cool | 346/41 |
| 2,621,998 | 12/1952 | Lewis | 346/42 |
| 3,378,831 | 4/1968 | Metcalf | 340/654 |
| 3,432,842 | 3/1969 | Poznanski | 340/570 |
| 3,531,790 | 9/1970 | Staley | 340/654 |
| 3,631,445 | 12/1971 | Shew | 340/570 |
| 3,750,161 | 7/1973 | Teeters | 340/418 |
| 3,786,501 | 1/1974 | Marnerakis | 340/409 |
| 3,792,493 | 2/1974 | Hughes | 346/20 |
| 4,015,256 | 3/1977 | Pratt | 340/409 |
| 4,155,077 | 5/1979 | Rohan et al. | 340/600 |
| 4,212,086 | 7/1980 | Stenling | 367/178 |
| 4,264,892 | 4/1981 | Zonn | 340/541 |
| 4,350,978 | 9/1982 | Riccobono | 340/550 |
| 4,476,461 | 10/1984 | Carubia | 340/667 |
| 4,583,082 | 4/1986 | Naylor | 340/545 |

*Primary Examiner*—Glen R. Swann, III
*Attorney, Agent, or Firm*—Mark E. Ogram

[57] ABSTRACT

A monitor utilizes a sensor which transmits a signal when a specific phenomenon has occurred. The time of the phenomenon is recorded in memory for later withdrawal and analysis by the operator. Being small, palm-sized, the monitor can easily be attached to such items as a drawer to monitor when the drawer is opened. Additionally, through the use of two-sided adhesive tape or the like, the security monitor can be easily moved from one location to another.

22 Claims, 2 Drawing Sheets

PORTABLE SECURITY MONITOR AND TIME RECORDING

BACKGROUND OF THE INVENTION

This invention relates generally to security devices and more particularly to portable devices.

Most thefts within a building are committed by internal personnel. These thefts are usually minor in cost in that small items are stolen. This type of theft is particularly difficult to solve since many different people had access to the location including cleaning personnel, co-workers, security personnel, and others.

In the field of industrial espionage, the theft itself might be undetectable since no physical items are removed, only the data, plans, layouts, or other proprietary material.

The first step in solving this type of crime is limit the number of suspects. That is, it is not feasible to consider all personnel who might have had access to the information or item. As noted earlier, this would include almost everyone from the cleaning crew to the security personnel.

To address this problem, there have been many proposed solutions including that described by U.S. Pat. No. 4,476,461 entitled "Occupancy Monitor", issued to Carubia on Oct. 9, 1984. In Carubia, a plurality of switches are spread throughout the building and by analyzing their activation, it is possible to determine if a specific room is occupied.

The Carubia system is "hard-wired" into the building and as such is static. That is, once the location of these switches are identified, by the cleaning personnel or co-workers, it is child's play to avoid them when entering the room. Carubia does not allow for changing of the pattern of detectors nor does it provide any simple means to protect new additions to the building.

Additionally, Carubia can be easily confused by the mere activation of a switch. That is by activating the switch upon the entry within the room and then providing a "false" entry by merely activating the switch again, it will appear to the computer that a person "accidentally" entered the room, realized his/her mistake, and instantly left the room. No cause for alarm, yet the intruder still remains within the room.

Another solution to the problem is proposed by Hughes in his patent entitled "Door Actuated Time Recorder", U.S. Pat. No. 3,792,493, issued Feb. 12, 1974. Hughes, as did Carubia, relies upon an elaborate and fixed system to provide security. As with Carubia, Hughes assumes that two signals from a door site indicate that a person entered and then left. As shown earlier, this is not always true.

Other inventions which have focused their attention on the activation of a door, include U.S. Pat. No. 2,051,986, entitled "Door Recorder" and issued to Cool on Aug. 25, 1936, and U.S. Pat. No. 2,621,998, issued to Lewis on Dec. 16, 1952. As noted earlier, these door-affixed measurements can be easily fooled and more importantly, are fixed so that their presence can be detected by the intruder and circumvented.

Another variation of monitoring the door, is to monitor the lock associated with the door. This was done in "Time Recorder for Locks" by Pullman, U.S. Pat. No. 1,452,846, issued Apr. 24, 1923. Again the fixed nature of the device together with its ability to be easily fooled, make the device totally unsuitable.

A fixed security system is particularly vulnerable to circumvention. These concerns are espoused in U.S. Pat. No. 4,015,256, "Electronic Control Unit for Intrusion System", issued to Pratt on Mar. 29, 1977. Pratt was so concerned with tampering with the control panel, that "the control center" is "hermetically encapsulated in a mass of hard plastic" (abstract).

Security extends past the ability to secure a room. The security for items stored within a drawer or filing cabinet are equally important. This application is impossible for either Carubia or Hughes to address due to their size, complexity, and the inability to address moveable items such as desks.

One solution which has been posed for securing desk drawers and the like is presented by Shew in U.S. Pat. No. 3,631,445, entitled "Burglar Alarm and Locking Device for Drawer", issued Dec. 28, 1971. Shew's device is a complex arrangement of locks and sensors which fits within the desk behind the drawer. Should an attempt to open the drawer be made without first using a key, then an alarm is sounded and a gripping mechanism prevents the drawer from being forced open.

The Shew device is designed for the few high-security drawers found within most offices. Because of its cost, complexity in use, and reduction in the drawer space, it is totally inappropriate for most drawers where a purse, loose change, or a calculator is kept. In this situation, the owner of the purse does not wish to have to continuously unlock the drawer for access to the purse.

Additionally, the Shew device is incapable of being moved. Once it is placed within the desk, it is permanently affixed and cannot be moved. Its very nature and use of the sensors prevent its removal.

Although some of the prior solutions are useful for their intended purpose, they all suffer due their basic concept. That is, they are intended to provide absolute security against theft. Although this is a problem, absolute security is much too costly to implement for everything (i.e. locking a calculator up at night requires too much capital equipment and manpower). Most items within a plant are "secured" by the thief's fear that he will be caught. Hence, the items which are locked away, although safe, are not of interest, what the thief is attracted to are the items which do not require the highest level of security such as cameras, calculators, desk-top computers. In the intelligence area, this would include general memos, letters, trashed spread sheets, and the like.

It is clear from the forgoing, that a system has not been generated with will assist in securing the vast majority of items.

SUMMARY OF THE INVENTION

The present invention creates a highly portable security monitor which can easily be moved from one location to another without undue difficulty. Additionally, the size of the monitor is kept minimal so that it can be secured in places heretofore infeasible for monitors.

As noted earlier, the vast majority of items within an office need a minimal level of security. These items are typically used every day and are of such relatively minor cost that a high level of security cannot be justified.

Unfortunately, once a thief has determined that a particular item is accessible and has struck once, the probability is that he/she will again hit the same target. Replacing a stolen item only provides a new target for the thief. Data is especially troublesome to protect since it is not physically removed but is photocopied, if on paper, or a copy of the diskette is made, if the data is stored on computer.

It turns out that a particular group of people have access to a particular room at specific times. As example, if it is known that the theft occurs from 3 a.m. to 4 a.m. when only the security guard is around, the list of possible suspects is narrowed significantly. In a like fashion, the cleaning personnel have access to a room only for a specific time frame. Knowledge of the exact time the theft occurred is therefore critical and usually will result in the thief's being identified.

The present invention is a security monitor that is palm-sized in nature. Being battery powered, it can be easily transported and attached in an out-of-the-way location where a thief does not expect to find a security monitor. The monitor's purpose is to identify when a specific physical phenomenon has occurred, which will indicate the presence of the thief within the vicinity or which will indicate the use of equipment by the thief or intruder.

Once the phenomenon is observed, the time of the occurrence is noted. In one embodiment of the invention, the duration of the occurrence is also noted.

The physical phenomenon which is being observed is the existence of light within the room, the existence of a current within an electrical conductor (indicating the use of a photocopier, computer, or automatically started equipment such as compressors or heating/cooling units), the movement of an object such as a drawer, or the like. The phenomenon which is to be monitored can be anything which indicates unauthorized activity.

There are many device known to those skilled in the art. They include:

Mechanical Switches- described in U.S. Pat. No. 3,432,842, entitled "Money Container with Integral Holdup Alarm". issued to Poznanski on Mar. 11, 1969;

Current Monitors—described in U.S. Pat. No. 3,786,501, entitled "Current Monitoring System and Method", issued to Marnerakis on Jan. 15, 1974;

Humidity Sensors- described in U.S. Pat. No. 4,350,978, entitled "Humidity-Sensitive Broken Panel Alarm", issued to Riccobono on Sept. 21, 1982;

Fire Detectors- described in U.S. Pat. No. 3,750,161, entitled "Fire Detector and Extinguisher System", issued to Teeters on July 31, 1973;

Door Position Sensor- described in U.S. Pat. No. 4,583,082, entitled "Optical Door Interlock", issued to Naylor on Apr. 15, 1986;

Vibration Sensors- described in U.S. Pat. No. 4,212,086, entitled "Measuring and Recording Device for Monitoring Vibrations Caused by Blasting", issued to Stenling on July 8, 1980; and, Vehicle Activity Sensor- described in U.S. Pat. No. 3,720,943, entitled "Vehicle Activity Recording Device", issued to Smith on Mar. 13, 1973.

All of the previously discussed sensor patents are incorporated by reference. Those of ordinary skill in the art can easily identify other sensors which can be used with the present invention.

The duration of the phenomenon is important to note in that it provides the ability to determine if a true breach of security has occurred. As example, the security personnel may momentarily switch on a light within a room for a brief security check, but the length of the light activation would indicate that a theft could not have occurred in the time available.

Since the present invention is battery powered, it can be easily moved to a new location for monitoring that area. In this manner, personnel can never become knowledgeable of the location of these monitors.

To be totally portable, the monitor is equipped with the means to easily attach the monitor to a new location. The preferred method for this type of attachment is through the use of two-side adhesive tape. In this type of tape, both sides contain an adhesive. This permits a strip of the two-sided tape to be placed on an object, such as the back of a drawer, and then the monitor pressed against the exposed side of the tape to secure the monitor against the drawer.

Another method is through the use of a bonding cloth in which the cloth is designed such that two pieces of the cloth adhere to each other yet permit the two pieces to be separated by gentle pressure. In this operation, one strip of the bonding cloth is glued to the monitor and the other strip is glued to the the item of interest such as the previously mentioned back of a drawer. By pressing the to strips of bonding cloth together, the monitor is attached to the drawer.

In the preferred embodiment of the invention, the display unit, used to communicate with an operator, is de-activated during normal operation. Only when the operator wishes to communicate with the monitor is the display activated.

In one embodiment of the invention, a security code must be entered before the security monitor will divulge the contents of its memory.

The invention, together with various embodiments thereof, will be more clearly described the accompanying drawings and their associated descriptions.

DRAWINGS IN BRIEF

Figure 6A:
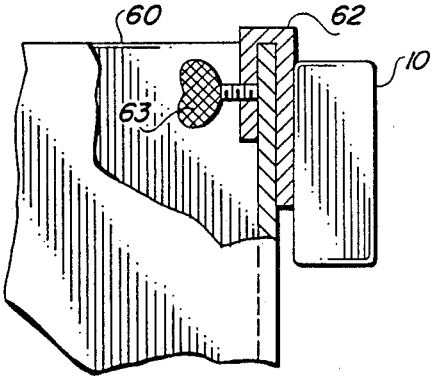
Figure 6B:
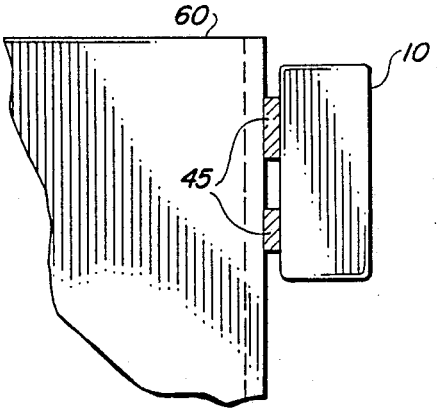

FIGS. 6*a* and 6*b* illustrate two methods for attaching an embodiment of the invention to a drawer.

DRAWINGS IN DETAIL

Figure 1:
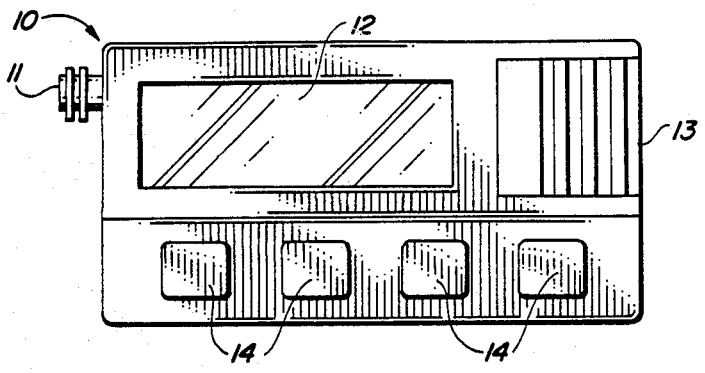
FIG. 1 is a frontal view of an embodiment of the invention.

FIG. 1 is a frontal view of an embodiment of the invention. The security monitor 10, is manufactured so that it is as small as feasible. In the preferred embodiment of the invention, the security monitor is palm-sized, that is, it fits comfortably within the palm of a human.

The security monitor 10 communicates with a sensor, not shown, via the input port 11. Input port 11 is threaded to permit easy attachment of a sensor and for the easy exchange of sensors. In the preferred embodiment, the security monitor comes with a variety of sensors so that the monitor's applications are expanded.

The security monitor 10 communicates with an operator via display 12 and keyboard 14. Keyboard 14 has a variety of keys to permit the operator to choose various operations for the security monitor.

The batteries of the monitor are stored within compartment 13.

Figure 2:
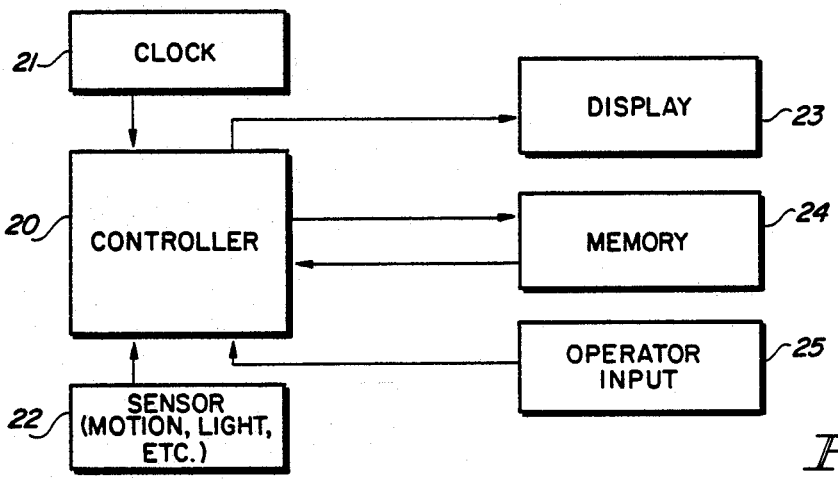
FIG. 2 is an block diagram of the different components of an embodiment of the invention and their interrelationship.

A block diagram of the interrelationship of the components of an embodiment of the invention are described in FIG. 2.

The controller 20 receives an electrical signal indicative of the existence of the physical phenomenon from sensor 22. The time of this occurrence is obtained from clock 21 and then stored in memory 24. When requested by the operator via operator input 25, the controller 20 withdraws the data from memory 24 and computes the time of initiation and the the duration of the phenomenon. This information is communicated to the operator via display 23.

In this manner, the controller obtains all of the information necessary for its operation and readily communicates the information to an operator.

Figure 3:
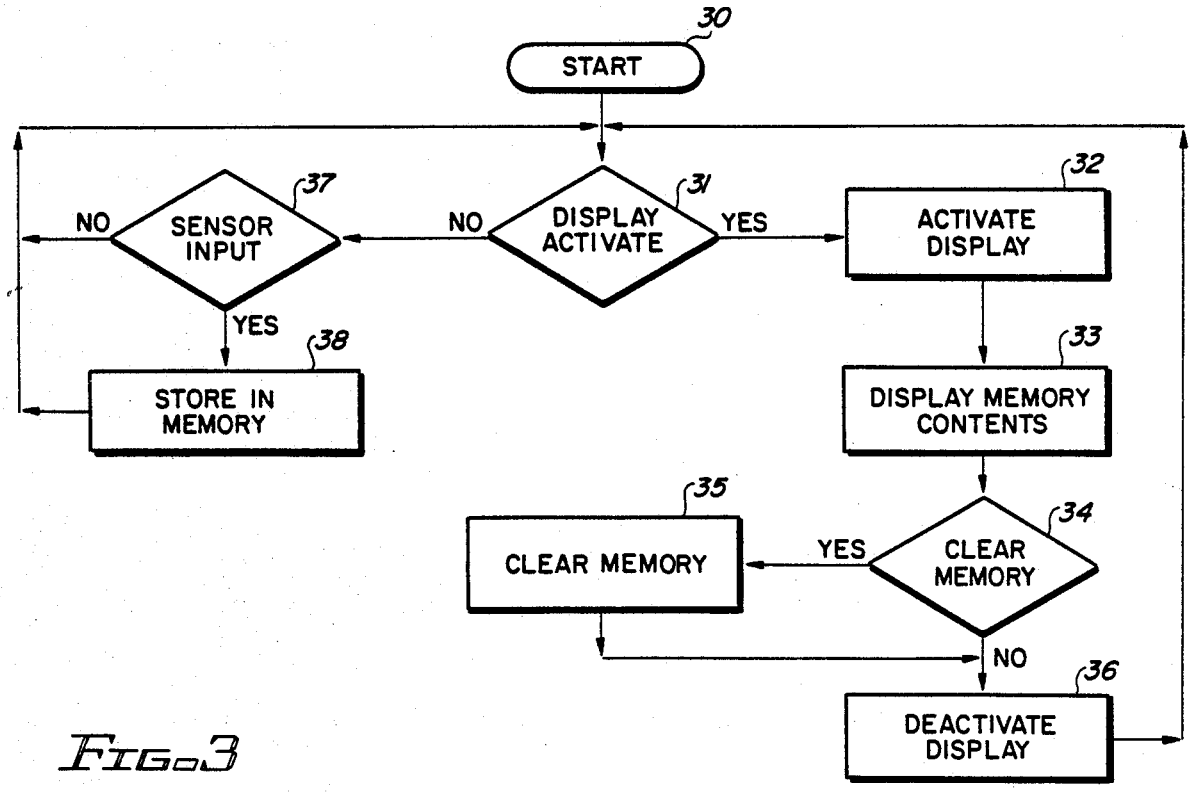
FIG. 3 is a flow chart diagram of the operation of one embodiment of the invention.

FIG. 3 is a flow-chart explanation of the operation of an embodiment of the invention.

Once start-up has occurred, 30, the security monitor determines if there has been a request to activate the display, 31. If there has been such a request, the display is activated, 32, and the contents of the memory are displayed for the operator, 33. The operator is then queried if the memory should be cleared, 34. If it is so desired, the memory is cleared 35 and the display is de-activated. This loop permits the memory to "blanked" so as to permit a new operation or to provide for a full complement of memory availability.

Once the memory has been de-activated, 36, the operation returns to a check for display activation 31. If none is requested, the sensor is checked to determine if input from the sensor is to be received, 37. Assuming that some input is to be received, the time of the occurrence is recorded in memory, 38, and the operation returns to a check for activation of the display, 31.

In this loop manner, the controller monitors the various inputs which will control its operation.

Figure 4:
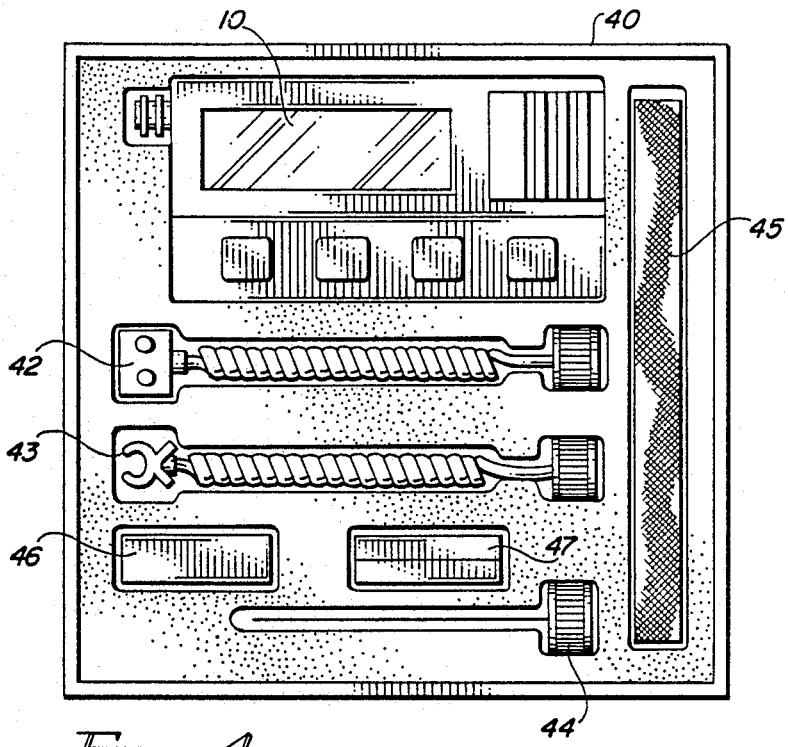
FIG. 4 is a pictorial view of the invention in one embodiment of the kit form.

FIG. 4 is a pictorial representation of the invention in its preferred kit form.

Kit 40 contains all the necessary equipment for an operator to put the security monitor into use. It includes the monitor itself, 41, together with various sensor 42, 43, and 44.

Sensor 42 is a switch sensor which contains two contacts which are connected when coupled by coupler 46. Coupler 46 is therefore mounted on a physical part which sensor 42 must pass. An example of this type of operation is the monitoring of the movement of a drawer ot the opening of a door.

Sensor 43 is designed to generate a signal when current is sensed within an electrical conductor. Sensor 43 is particularly useful when it is important to monitor if a photocopier has been operated or if a computer has been activated. Sensor 43 then can be placed on the electrical supply line to the photocopier or it can be placed on the signal line to the monitor of the computer.

Sensor 44 is a trip switch which is activated when its antenna is moved. To create this movement, trip 47 is attached to a relatively stationary body such as the desk while sensor 44 is attached to the drawer.

Attachment means 45 are included in the kit 40. In this example bonding cloth is enclosed in which one strip can be attached to the monitor 41 while the other is attached to a target site.

The kit illustrated in FIG. 4 is particularly useful since it supplies the operator with all of the necessary components to deploy the monitor.

Figure 5:
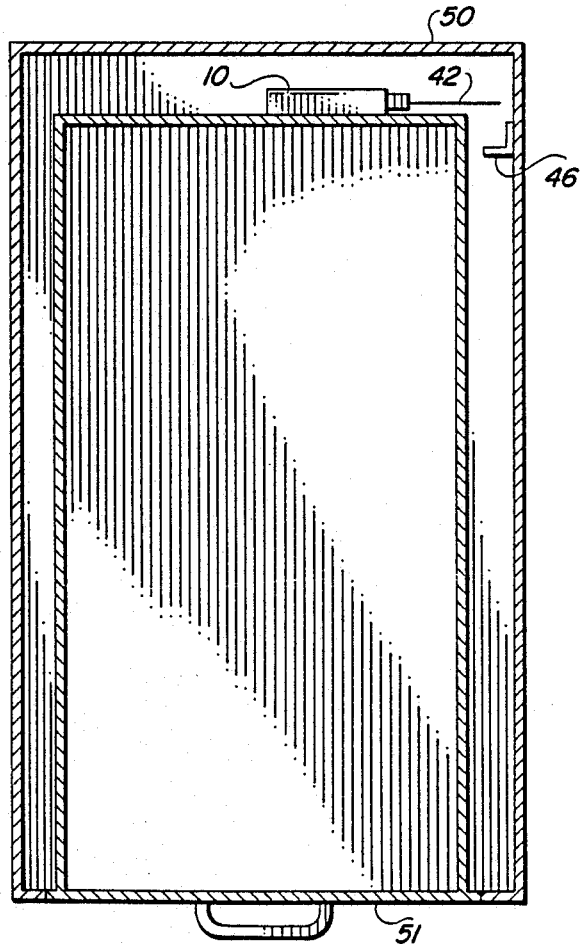
FIG. 5 is a cut-away view of one embodiment of the invention having been mounted within a drawer.

FIG. 5 is an illustration of the invention when used within a filing cabinet type arrangement.

The filing cabinet frame 50 houses drawer 51. At the back of drawer 51 is secured the security monitor 52. Security monitor 52 has a trip sensor 53 communicating with it. When drawer 51 is withdrawn, the trip sensor 53 comes into contact with tripper 54 which is secured to the cabinet 50. This contact causes the trip sensor 53 to generate a signal which is communicated to the security monitor 52.

FIGS. 6*a* and 6*b* illustrate two different methods which may be used to secure the security monitor to the rear of a drawer. In other embodiments of the invention, the security monitor is mounted to the bottom or the side of the drawer.

Referring to FIG. 6*a*, drawer 60 is to have security monitor 61 attached thereto. Attached to security monitor 61 is bracket 62. Bracket 62 extends over the lip of drawer 60 and then protrudes down into the inside of drawer 60. Set screw 63 is then tightened against the back of drawer 60 so as to firmly attach the bracket, 62, and hence the security monitor 61.

Referring now to FIG. 6*b*, again security monitor 61 is to be attached to drawer 60. In this application though, two-sided adhesive tape 64 is placed between the drawer 60, and security monitor 61. The two-side adhesive tape 64 securely affixes the two yet allows for easy removal at a later date.

It is clear from the foregoing that the present invention solves the problems created by the existing art and creates a device which is easily installed and moved, thereby creating a totally new level of security protection.

What is claimed is:

1. An occurrence monitor comprising:

a. a sensor means for generating an electrical signal upon the occurrence of a preselected physical phenomenon within the environment surrounding the occurrence monitor; and, b. a palm sized monitor having:

1 a clock means, 2. a connector means for connecting/disconnecting said sensor means to said palm sized monitor, 3. an electronic memory means, 4. a controller means in communication with said clock means, said sensor means, and said electronic memory means, said controller means recording in said electronic memory means, the time as defined by said clock means, of any electrical signal received from said sensor means via said connector means, and, 5. fastening means permitting said palm sized monitor to be coupled to and decoupled from a selected object.

2. The occurrence monitor according to claim 1 further comprising an operator communication means.and wherein said controller means communicates data stored within said memory means to an operator.

3. The occurrence monitor according to claim 2 wherein said operator communication means includes a display device.

4. The occurrence monitor according to claim 2 wherein said fastening means includes a double sided adhesive tape.

5. The occurrence monitor according to claim 2 wherein said fastening means includes at least two strips of bonding cloth material wherein a strip of bonding cloth material will cling to a second strip of bonding cloth material.

6. The occurrence monitor according to claim 2 wherein said sensor means includes means for sensing a preselected level of light.

7. The occurrence monitor according to claim 2 wherein said sensor means includes means for sensing the existence of a preselected level of current within an electrical conductor.

8. The occurrence monitor according to claim 2 wherein said sensor means includes switching means being activatable upon the movement of a physical item.

9. A method of deploying a security monitor including the steps of:

a. mounting said security monitor in an unobtrusive location;

b. connecting to said monitor, a sensor which generates a signal upon the occurrence of a selected phenomenon; and, c. causing said monitor to record the time of any occurrence of the selected phenomenon.

10. The method of deploying a security monitor according to claim 9, further including the step of communicating the times of all recorded occurrences of said selected phenomenon.

11. The method of deploying a security monitor according to claim 9, further including the step of initializing the time of said security monitor to local time prior to the mounting of said security monitor.

12. A method of operating a security monitor including the steps of repetitively:

A. monitoring the input line of a remote phenomenon-sensor for a signal, once having the input, 1. obtaining the time of said input from a clock, and, 2. recording the time of said input within a memory unit;

B. checking an operator interface to determine if there exists operator-generated interrupt data thereon and upon the existence of said operator-generated interrupt data, 1. activating a display device, and 2. communicating all material stored within said memory unit to the operator.

13. The method of operating a security monitor according to claim 12, including after activating the display device, the steps of:

A. prompting the operator for entry of a security code; and

B. comparing the entered security code with a preselected stored code.

14. The method of operating a security monitor according to claim 13, including, after the step of comparing the entered security code to a preselected code, the step of aborting operation should the entered security code and the stored code do not match.

15. The method of operating a security monitor according to claim 13, including, after the step of comparing the entered security code to a preselected code, the step of storing the time of said comparison within said memory device.

16. A security kit comprising:

A. a security monitor having, 1. clock means for generating data identifying the time of day, 2. electronic memory means for the storage of data, 3. an input port for the receipt of an electrical signal, and, 4. a control means for, a. monitoring the input port for the existence of said electrical signal, b. obtaining from the clock means data relative to the time of said electrical signal, and, c. storing the data from said clock means within said electronic memory means;

B. at least two sensors being individually connectable to said security monitor via said input port, each of said sensors capable of causing an electrical signal to be communicated upon the occurrence of a physical phenomenon surpassing a preselected threshold; and, C. means to attach said security monitor to a selected item.

17. The security monitor kit according to claim 16 wherein each of said sensors is activated by a different physical phenomenon.

18. The security monitor kit according to claim 16 wherein said means to attach are detachable.

19. The security monitor kit according to claim 16 wherein one of said sensors is activated by the existence of light beyond a preselected threshold.

20. The security monitor kit according to claim 16 wherein one of said sensors is activated by the existence of current within a conductor beyond a preselected threshold.

21. An occurrence monitor comprising:

a. a sensor means for generating an electrical signal upon the occurrence of a preselected physical phenomenon within the environment surrounding the occurrence monitor;

b. a palm sized monitor having:

1. a clock means, 2. operator communication means including a display device, 3. operator input means for communicating data from an operator, 4. a connector means for connecting/disconnecting said sensor means to said palm sized monitor, 5. an memory means, 6. a controller means in communication with said clock means, said sensor means, and said memory means, said controller means recording in said memory means, the time as defined by said clock means, of any electrical signal received from said sensor means via said connector means, and wherein the controller means communicates data stored within said memory means to an operator via said operator communication means, and, wherein said controller means deactivates said display device except upon the input of selected data from said operator, and, 7. fastening means permitting said palm sized monitor to be coupled to and decoupled from a selected object.

22. The occurrence monitor according to claim 21 wherein the data generated from an operator via said operator input means causes said controller means to erase all occurrence data from said memory means.

* * * * *